US006158254A

United States Patent [19]

Richard

[11] Patent Number: 6,158,254

[45] Date of Patent: Dec. 12, 2000

[54] DOUBLE LAYER SOCK AND METHOD OF MAKING

[75] Inventor: James R. Richard, Newton, N.C.

[73] Assignee: Ridgeview, Inc., Newton, N.C.

[21] Appl. No.: 09/455,595

[22] Filed: Dec. 6, 1999

[51] Int. Cl.[7] ..... O04B 9/56; A41B 11/01

[52] U.S. Cl. ..... 66/179; 66/21; 66/147; 2/239

[58] Field of Search ..... 66/8, 13, 16, 19, 66/21, 22, 23, 40, 215, 54, 147, 148, 172 R, 178 R, 179, 185, 186, 187; 2/239, 241

[56] References Cited

U.S. PATENT DOCUMENTS

| | | | |
|---|---|---|---|
| 379,831 | 3/1888 | Sutro . | |
| 3,721,111 | 3/1973 | Billi | 66/187 |
| 3,796,067 | 3/1974 | East | 66/178 |
| 3,800,559 | 4/1974 | Fecker | 66/187 |
| 4,341,096 | 7/1982 | Safrit et al. | 66/185 |
| 4,467,626 | 8/1984 | Coble et al. | 66/196 |
| 4,571,960 | 2/1986 | Hursh et al. | 66/196 |
| 4,615,188 | 10/1986 | Hursh et al. | 66/196 |
| 4,958,507 | 9/1990 | Allaire et al. | 66/19 |
| 5,675,992 | 10/1997 | Wrightenberry | 66/178 |
| 5,778,702 | 7/1998 | Wrightenberry | 66/178 |
| 5,814,003 | 9/1998 | Knox et al. | 602/63 |

*Primary Examiner*—Danny Worrell
*Attorney, Agent, or Firm*—Olive & Olive, P.A.

[57] ABSTRACT

A double layer sock is formed on a circular knitting machine so that the inner layer and the outer layer are connected by knit stitches adjacent the toe portion and the inner and outer layer wales adjacent such connection are aligned. A section of knit courses is formed beyond the connected toe portion of both the inner and outer layer as an inner guide segment, an inner clip, an outer guide segment, and an outer clip, with each guide segment formed at a lower stitch density than either the toe portion or the clip that border the guide segment.

4 Claims, 2 Drawing Sheets

DOUBLE LAYER SOCK AND METHOD OF MAKING

FIELD OF THE INVENTION

The present invention relates to socks, and more particularly to double layer socks for athletic use and a method of making the same.

BACKGROUND OF THE INVENTION

Socks provide comfort, insulation and protection to the feet of the wearer. Socks are produced in a variety of styles to serve numerous functions, including dress, casual, and athletic, with additional variations achieved through use of different yarns and patterns.

Athletic socks are used in many activities, such as in walking, tennis, basketball, and skiing, all of which can cause the feet to perspire and be fatigued or injured. It has long been recognized that by increasing the thickness of the sock, perspiration is more effectively absorbed and any impact from the athletic activity is cushioned.

Socks are almost universally made by knitting on what is known in the trade as a circular knitting machine. A circular knitting machine knits a tubular fabric structure through the controlled actions of a multiplicity of latch needles and sinkers on a length of yarn. A typical circular knitting machine in use today is a Lonati 454 J machine, made by the Lonati Company, S.P.A. of Brescia, Italy. The Lonati 454 J machine has 108 latch needles that are located circumferentially around its needle cylinder. The knitting action as well as the stitch density is controlled through a program of instructions installed on a microprocessor. This type of machine also incorporates a dial plate with hooks as later referred to.

Single, as well as double layer socks are generally knit with a rim surrounding an opening at the leg portion and an opening at the toe portion. The toe opening of a machine knit sock is typically closed in a separate operation performed on a model 222 Complett automatic sewing machine made by Conti Complett, S.P.A. of Milan, Italy. The Complett sewing machine has a guide with a slot through which its operator passes a relatively thin fabric segment adjacent the toe opening of the sock. The sewing machine has a pair of opposed gripper chains that move the sock through a trimming section to remove the fabric that is beyond the relatively thin segment and then through a sewing section to close the sock toe seam.

Traditional means of increasing the thickness of socks involves producing a pair of socks with a terry layer such as that disclosed in U.S. Pat. No. 3,796,067 to East in which the sock has a smooth knit layer and a terry layer. The '067 patent teaches forming the sock by knitting of an elongate tube and inverting one half within the other half to achieve two layers.

Socks made with partial multiple layers are disclosed in U.S. Pat. No. 4,431,096 to Safrit et al. which shows a sock having a triple layer fabric in the foot portion; and U.S. Pat. No. 4,467,626 to Coble et al. which shows a sock with a double layer in the foot portion. Socks made with a full multiple layer are also disclosed in U.S. Pat. No. 4,571,290 to Hursh et al. which shows a two-ply athletic sock with low-friction interface surfaces; and U.S. Pat. Nos. 5,675,992 and 5,778,702 to Wrightenberry which show double layer socks and methods of making such socks.

Double layer socks of the kind described above provide the desired multiple layers, but have the disadvantage of requiring a relatively large labor component to produce, resulting in higher prices to the consumer or lower profit for the manufacturer. Many of these double layer socks are closed at the toe by sewing the toe of the inner layer closed and then sewing the toe of the outer layer closed, in which case the inner and outer toe sections are not connected, leading to bunching, twisting and other causes of discomfort to the wearer. Alternatively, the inner and outer toes are closed together by manually aligning the knitting wales of the two layers to avoid the undesired twisting, but increase the time and cost to manufacture.

A further method of construction of a double layer sock is disclosed in U.S. Pat. No. 4,958,507 to Allaire et al. The method of the '507 patent begins with the step of knitting a sock with a first course that is transferred to a transfer plate (also known as a dial plate) to remain in standby while the balance of the double layer sock body is knitted. The retained first course is then transferred from the dial plate at the end of the knitting process to form a connection between the inner layer and the outer layer at the toe. When the inner and outer layers are connected at the toe, additional courses are knit to form a single tubular terminal layer that extends beyond the two sock layers. The method of the '507 patent overcomes the alignment and twisting problem noted above, but fails to provide what is later referred to as a low stitch-density "guide" fabric which enables the toe seam to be efficiently closed.

The object of the invention is thus to provide an improved method for producing a double layer sock and an improved sock produced by such method. Other objects will become apparent as the description proceeds.

SUMMARY OF THE INVENTION

The invention provides a double layer sock and method of making in which the inner toe and the outer toe are integrally stitched closed with respective inner and outer wales aligned. The sock inner layer is knit with a first tubular segment of normal stitch density (this segment being referred to as the "clip") and a second tubular segment of low knit density (this segment being referred to as the "guide segment") and then the balance of the sock body is knit with normal stitch density to complete the inner layer of the sock. The knitting continues with an outer layer of the sock joined to the inner layer along a fold line and having normal stitch density, a third tubular segment of low knit density (a "guide segment"), and a final tubular segment of normal knit density (a "clip"). The inner and outer toe portions are maintained with their wales in alignment by holding the first tubular segment on a transfer dial plate as the balance of the knitting is completed and then the respective second and third tubular "guide" segments of each layer are connected by knitting a series of bridge stitches. The sock is then discharged from the knitting machine and transferred to a toe closing sewing machine. In the toe closing operation which is facilitated by the presence of the guide fabric, the toe is seamed by sewing through the fabric of both layers inward of the guide segment after the clip has been removed.

An improved double layer sock is achieved both at less cost to manufacture and with greater comfort for the wearer due to eliminating the bunching and twisting referred to above.

BRIEF DESCRIPTION OF THE DRAWINGS

In order for the invention to become more clearly understood it will be disclosed in greater detail with reference to the accompanying drawings, in which.

DESCRIPTION OF THE PREFERRED EMBODIMENT

Figure 1:
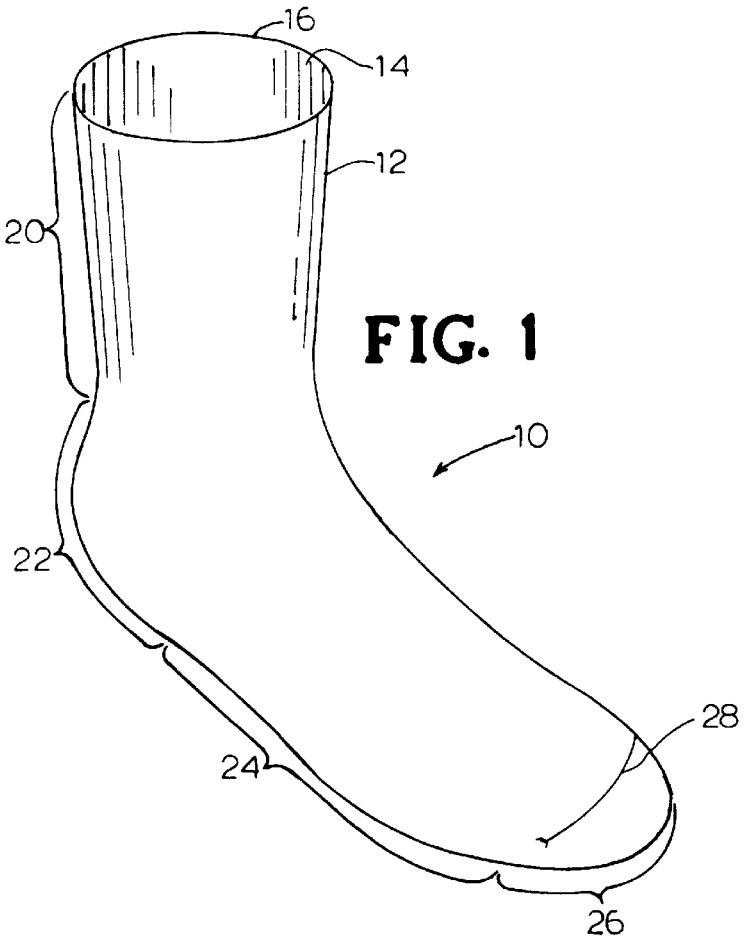
FIG. 1 is a perspective view of the double layer sock of the invention as it appears ready for wear and after the toe has been closed.

FIG. 1 illustrates a completed double layer sock 10 that has been knitted by the method of the invention including tubular outer layer 12 and tubular inner layer 14, connected at the top by the folded fabric portion designated rim 16. As used herein, the terms outer layer and inner layer are used to describe the respective layers of sock blank 10B (FIG. 2) as it is knit, which may not agree with the layer positioning as the complete sock 10 (FIG. 1) is worn. Double layer sock 10 has leg portion 20 that is contiguous with heel portion 22 which in turn is contiguous with foot portion 24 and which in turn is contiguous with toe portion 26. As will be described below, toe portion 26 of sock blank 10B is formed on the circular knitting machine with toe opening 44 (FIG. 2) that is subsequently closed by a later described sewing operation to form toe closure seam 28.

The example described as the preferred embodiment herein relates to a conventionally shaped sock with a formed heel pocket and a formed toe pocket to achieve the traditional "L" shape and to position the toe closure seam on the top of the toe portion. However, it should be understood that the novel principles of the present invention pertain equally to what is known as a "tube sock," having a substantially straight, tubular shape through the leg and foot portions, with no machine-formed heel or toe pocket. Additional sock configurations, such as a sock having a formed heel pocket and a straight toe, etc., are similarly contemplated by the invention.

Figure 2:
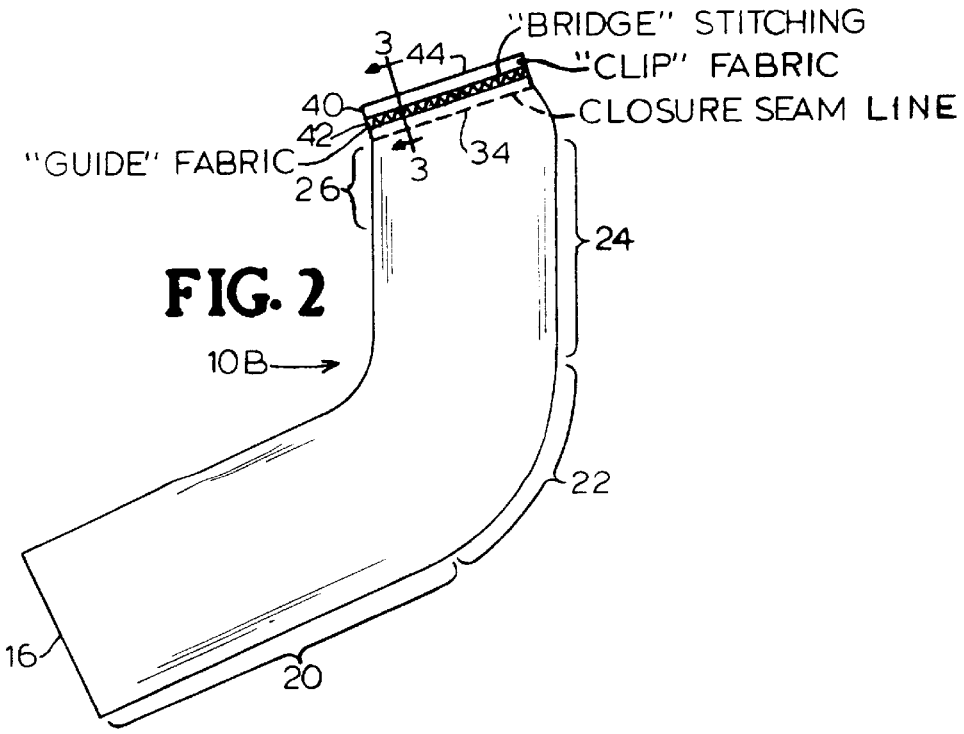
FIG. 2 is a side elevation view of the double layer sock of the invention as it appears at the completion of the knitting process but prior to having the toe closed.

Referring now to FIG. 2, double layer sock blank 10B of the invention is shown in its completely knitted condition before toe closure seam 28 of FIG. 1 has been made. For purposes of description, double layer sock blank 10B is illustrated in an orientation with its toe portion 26 near the top as it is formed on the knitting machine. As noted above, sock blank 10B comprises toe portion 26, foot portion 24, heel portion 22, and leg portion 20. The uppermost part illustrated is toe opening 44, below which appears the knitted fabric portion referred to as "clip" 40 of normal stitch density and contiguous knitted fabric referred to as "guide segment" 42 of low stitch density, examples of which are given later. A dashed line 34 is imposed on sock blank 10B to illustrate the position at which stitching will be done to close toe opening 44.

Figure 3:
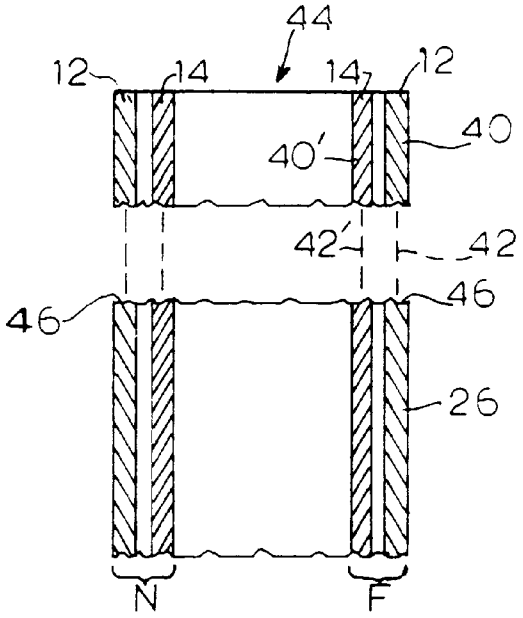
FIG. 3 is an enlarged cross sectional view of a portion of the double layer sock of the invention taken in the direction of line 3—3 of FIG. 2.

Referring now to FIG. 3, a partial section of double layer toe portion 26 and outwardly adjacent guide portions 42, 42' and clips 40, 40' is shown in enlarged cross sectional view. Outer layer 12 is seen in close proximity to inner layer 14 at the near side and far side F of sock blank 10B, separated by toe opening 44. Clips 40, 40' having normal density stitching are connected to the respective layers 12, 14 of toe portion 26 by guide segment 42, 42' of low stitch density. Also to be noted in FIG. 3 is that outer layer 12 is connected to inner layer 14 by bridge stitches 46 formed on the knitting machine and passed through the inner boundary of the respective guide segment 42, 42'. It is the presence of the stitched together guide segments 42, 42' which has been found to greatly enhance the efficiency of the toe closing operation.

Figure 4:
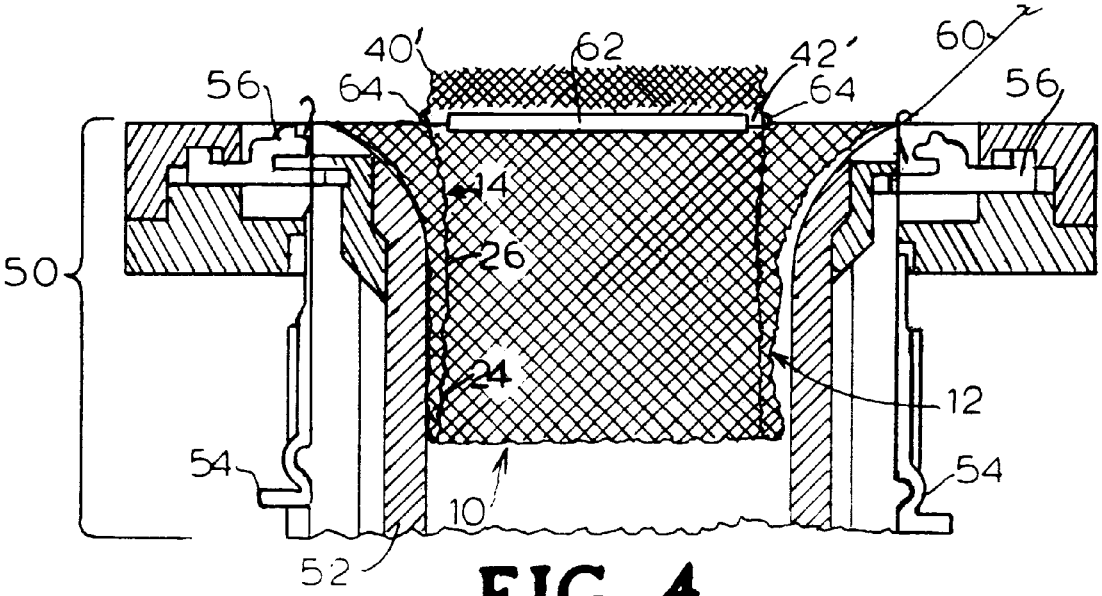
FIG. 4 is a cross sectional schematic view of the needle cylinder portion of a circular knitting machine of the type on which the double layer sock of the invention is knitted.

FIG. 4 schematically illustrates circular knitting machine 50 in cross section. Circular knitting machine 50 includes annular needle cylinder 52 through which the tubular fabric structure being knitted passes. A dial plate 62 is positioned concentrically adjacent the upper end of needle cylinder 52. Dial plate 62 has a number of hooks 64 oriented radially and distributed evenly around the periphery of dial plate 62. Each hook 64 is extended or retracted by a controllable mechanism, for example a pneumatic cylinder (not shown). The circular knitting operation is performed by the alternate hooking and shedding of yarn loops by a series of latch needles 54 positioned around needle cylinder 52 and interacting with a respective series of sinkers 56, as is known.

Referring further to FIG. 4, the method of the invention first involves knitting yarn 60 through the actions of needles 54 and sinkers 56 around needle cylinder 52 to form inner layer 14, beginning with its respective clip 40' that is formed as a first plurality of courses, for example 16 courses. The courses comprising clip 40' are formed of a normal stitch density, for example 12.6 stitches per centimeter (32 stitches per inch). Next, knitting continues at a lower stitch density, for example 3.1 stitches per centimeter (8 stitches per inch) to form a series of courses referred to as guide segment 42', for example, four courses. At the completion of knitting the respective courses comprising guide segment 42', the knitting resumes at a normal stitch density. After a further one or more courses, beyond those courses comprising guide segment 42', are knit, hooks 64 extend from dial 62 and pick up the knit portions of inner layer 14 to hold it in reserve. The balance of inner layer 14, comprising toe portion 26, foot portion 24, heel portion 22, and leg portion 20 is knit with normal stitch density. The relative degree of normal and lower stitch density is disclosed as an example and is not to be construed as a limitation of the scope of the invention. By providing courses in the respective guide segments 42, 42' with lower stitch density than in bordering clips 40, 40' and toe portion 26, guide segments 42, 42' become readily positionable in the slot guide of the trimming and sewing machine employed for the closure of toe seam 28 (see FIG. 1) to greatly facilitate the toe closing operation and make it more efficient than past practice with socks of different construction.

At the completion of knitting inner layer 14, the operation continues to knit outer layer 12 through the sequential formation of leg portion 20, heel portion 22, foot portion 24, and toe portion 26. During the entirety of the sock knitting process, the portion of sock blank 10B held on hooks 64 drapes downwardly from dial plate 62 and then upwardly to contact needle cylinder 52 adjacent needles 54 and sinkers 56 as depicted in FIG. 4.

The next step is to release inner layer 14 from hooks 64 and interknit bridge stitches 46 (FIG. 3) to join inner layer 14 and outer layer 12. Since inner layer 14 has been held in fixed position by radially disposed hooks 64, the wales making up inner layer 14 and the wales making up outer layer 12 adjacent toe opening 44 are aligned with one another without the need of manual intervention.

The knitting operation then proceeds to knit a further guide segment 42 at lower switch density and extending outwardly from bridge stitches 46. Upon completion of knitting guide segment 42, clip 40 is knit at normal stitch density during which inner layer 14 and outer layer 12 remain connected to one another by means of bridge stitches 46. At the completion of knitting clip 40 of outer layer 12, the knitting operation is done and sock blank 10B is released to drop through needle cylinder 52 to a receptacle (not shown).

After sock blank 10B has been released, it is inverted and transferred to a sewing machine, such as the Complett machine identified above, where toe closure seam 28 is formed to complete sock 10 as seen in FIG. 1. In this operation, guide segment 42, 42' is placed into the slot in the sewing guide of the Complett machine and gripped by its drive chains. As the drive chains move sock blank 10B, clips 40, 40' are trimmed off and the toe portion of the inner layer and outer layer is stitched to form the toe seam 28 as seen in see FIG. 1. The now completed sock 10 is then re-inverted so that toe seam 28 is hidden within. As previously stated and what is important to recognize is that the forming of toe closure 28 is greatly facilitated by the presence of connected together low stitch-density guide segment 42, 42' with the end result being both a reduction in the labor component required to make the double layer sock and a double layer sock characterized by the absence of bunching and twisting in the toe seam area. Similar benefit would be obtained by sock 10 of the invention with the toe seam formed and kept on the exterior of sock 10.

As will be understood by those skilled in the art, double layer socks can be knit according to the present invention with the use of various types of yarn in various weights. The selection of natural or synthetic yarn, textures, and patterns is dependent on the anticipated use to which the socks may be put.

The detailed description of a preferred embodiment of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A double layer sock formed on a circular knitting machine having means to control the stitch density and fitted with a dial plate having hooks and said sock having its toe closed by a sewing machine fitted with a sewing guide and severing means, by a method comprising:

(a) knitting a first tubular segment of said sock with stitches of normal density;

(b) knitting a second tubular segment of said sock contiguous with said first segment and in which the stitches forming the second segment are less dense than the stitches forming the first segment;

(c) knitting a tubular inner layer of said sock that is a contiguous with said second segment;

(d) engaging stitches of a first course of said inner layer of said sock on hooks of a dial plate of said knitting machine;

(e) while said inner layer first course remains engaged on said hooks, knitting a tubular outer layer of said sock that is contiguous with said inner layer;

(f) disengaging said inner layer first course from said hooks;

(g) forming knit stitches connecting said inner layer first course to an outer layer last course;

(h) knitting a third tubular segment of said sock contiguous with said outer layer and in which the stitches forming the third segment are less dense than the stitches forming the outer layer;

(i) knitting a fourth tubular segment of said sock contiguous with said third segment in which the stitches forming the fourth segment are more dense than the stitches forming the third segment;

(j) discharging said sock from said knitting machine;

(k) engaging said second and third tubular segments of said sock in a slot of a sewing machine sewing guide;

(l) while maintaining said second and third tubular segments engaged in said guide, severing said first and fourth tubular segments of said sock from said second and third tubular segments; and (m) sewing said inner and outer layers adjacent said second and third tubular segments to each other while maintaining the wales of said inner land outer ayers proximate the line of sewing in alignment.

2. The double layer sock as described in claim 1, wherein said inner and outer layers each comprise a toe portion, a foot portion, a heel portion, and a leg portion.

3. A method for making a double layer sock on a circular knitting machine fitted with a dialplate having hooks and having means to control the stitch density, comprising the steps of:

(a) knitting a first tubular segment of a sock with stitches of normal density;

(b) knitting a second tubular segment of said sock contiguous with said first segment in which the stitches forming the second segment are less dense than the stitches forming the first segment;

(c) knitting a tubular inner layer of said sock that is contiguous with said second segment;

(d) engaging stitches of a first course of said inner layer of said sock on hooks of a dial plate of said knitting machine;

(e) while said inner layer first course remains engaged on said hooks, knitting a tubular outer layer of said sock that is contiguous with said inner layer;

(f) disengaging said inner layer first course from said hooks;

(g) forming knit stitches connecting said inner layer first course to an outer layer last course;

(h) knitting a third tubular segment of said sock contiguous with said outer layer sock portion in which the stitches forming the third segment are less dense than the stitches forming the outer layer;

(i) knitting a fourth tubular segment of said sock contiguous with said third segment whereby the stitches forming the fourth segment are more dense than the stitches forming the third segment; and (j) discharging said sock from said knitting machine.

4. A double layer sock comprising:

(a) a knit sock body including an inner layer and an outer layer formed by knit stitches in wales and connected at a rim at a first end of the sock body;

(b) a toe closure seam with said inner and outer layers closed as a unit at a second end of the body;

(c) the wales making up the inner and outer layers in the vicinity of the toe closure seam being aligned; and (d) portions of said layers outwardly of said seam being knit with a stitch density less than the stitch density of the layers through which said seam is formed.

* * * * *